US010524970B2

(12) United States Patent
Dick et al.

(10) Patent No.: US 10,524,970 B2
(45) Date of Patent: Jan. 7, 2020

(54) FOLDING WHEELCHAIR

(71) Applicant: OTTO BOCK MOBILITY SOLUTIONS GMBH, Konigsee-Rottenbach (DE)

(72) Inventors: Sergej Dick, Hannover (DE); Patrick Hoehn, Meuselbach-Schwarzmuhle (DE)

(73) Assignee: OTTO BOCK MOBILITY SOLUTIONS GMBH, Konigsee-Rottenbach (DE)

( * ) Notice: Subject to any disclaimer, the term of this patent is extended or adjusted under 35 U.S.C. 154(b) by 0 days.

(21) Appl. No.: 15/536,611

(22) PCT Filed: Dec. 16, 2015

(86) PCT No.: PCT/DE2015/100538
§ 371 (c)(1),
(2) Date: Jul. 10, 2017

(87) PCT Pub. No.: WO2016/095908
PCT Pub. Date: Jun. 23, 2016

(65) Prior Publication Data

US 2017/0348168 A1 Dec. 7, 2017

(30) Foreign Application Priority Data

Dec. 19, 2014 (DE) ..... 10 2014 019 679

(51) Int. Cl.
*A61G 5/08* (2006.01)
*A61G 5/10* (2006.01)

(52) U.S. Cl.
CPC ..... *A61G 5/1064* (2013.01); *A61G 5/08* (2013.01); *A61G 5/0825* (2016.11); *A61G 5/0883* (2016.11)

(58) Field of Classification Search
CPC .. A61G 5/1064; A61G 5/0825; A61G 5/0883; A61G 5/08; A61G 5/1067
(Continued)

(56) References Cited

U.S. PATENT DOCUMENTS 2,914,111 A 11/1959 Mize
5,904,168 A 5/1999 Alulyan
(Continued)

FOREIGN PATENT DOCUMENTS

CN 1186649 A 7/1998
CN 201921022 U 8/2011
(Continued)

OTHER PUBLICATIONS

PCT International Search Report for PCT International Patent Application No. PCT/DE2015/100538, dated Mar. 29, 2016.

*Primary Examiner* — Mark R Wendell
(74) *Attorney, Agent, or Firm* — Holland & Hart, LLP

(57) ABSTRACT

A folding wheelchair includes two side frames, which are connected to each other via a cross-strut. A fabric is stretched between the side frames in order to form a seating area of a seat. The side frames are formed identically and include an outer tube and an inner tube. The outer tubes have a slot extending in a longitudinal direction (L), which opens at least into an outer tube end. The inner tubes each include a slot extending in the longitudinal direction (L), which opens at least into an inner tube end. A tensioning rod is accommodated in one of the outer tubes and opens into the associated inner tube. The fabric is led to the outside through the slots of the inner tube and outer tube. The inner tube, the fabric and the tensioning rod are connected to one another.

20 Claims, 7 Drawing Sheets

(58) Field of Classification Search
USPC ..... 297/284.3
See application file for complete search history.

(56) References Cited

U.S. PATENT DOCUMENTS

| | | | | |
|---|---|---|---|---|
| 6,499,762 | B1 * | 12/2002 | Rogers | A61G 5/0883 280/650 |
| 7,938,434 | B2 | 5/2011 | Smith | |
| 8,449,032 | B2 | 5/2013 | Serhan | |
| 8,602,424 | B2 | 12/2013 | Liu | |
| 10,123,922 | B2 * | 11/2018 | Gingras | A61G 5/10 |
| 2006/0145456 | A1 * | 7/2006 | Munsey, Sr. | A61G 5/08 280/649 |
| 2009/0194974 | A1 | 8/2009 | Smith | |
| 2011/0175329 | A1 * | 7/2011 | Gingras | A61G 5/08 280/647 |
| 2012/0007341 | A1 | 1/2012 | Masaki | |
| 2017/0333268 | A1 * | 11/2017 | Gingras | A61G 5/10 |
| 2017/0348168 | A1 * | 12/2017 | Dick | A61G 5/08 |
| 2018/0311087 | A1 * | 11/2018 | Horacek | A61G 5/08 |

FOREIGN PATENT DOCUMENTS

| | | | |
|---|---|---|---|
| CN | 102309382 | A | 1/2012 |
| DE | 29718536 | U1 | 2/1998 |
| DE | 29724574 | U1 | 2/2002 |
| DE | 20221587 | U1 | 8/2006 |
| RU | 2104683 | C1 | 2/1998 |
| RU | 62514 | U1 | 4/2007 |

* cited by examiner

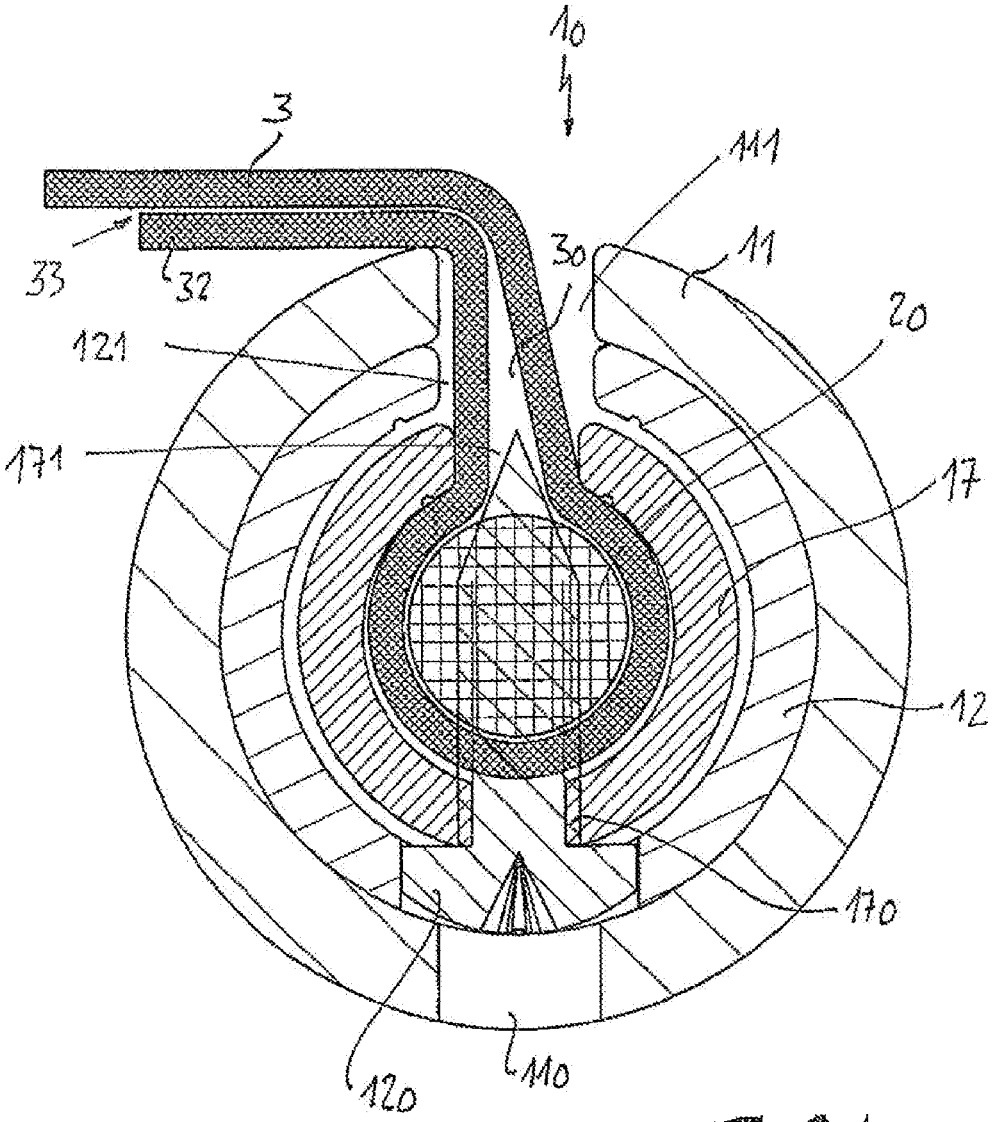
Fig. 8.1

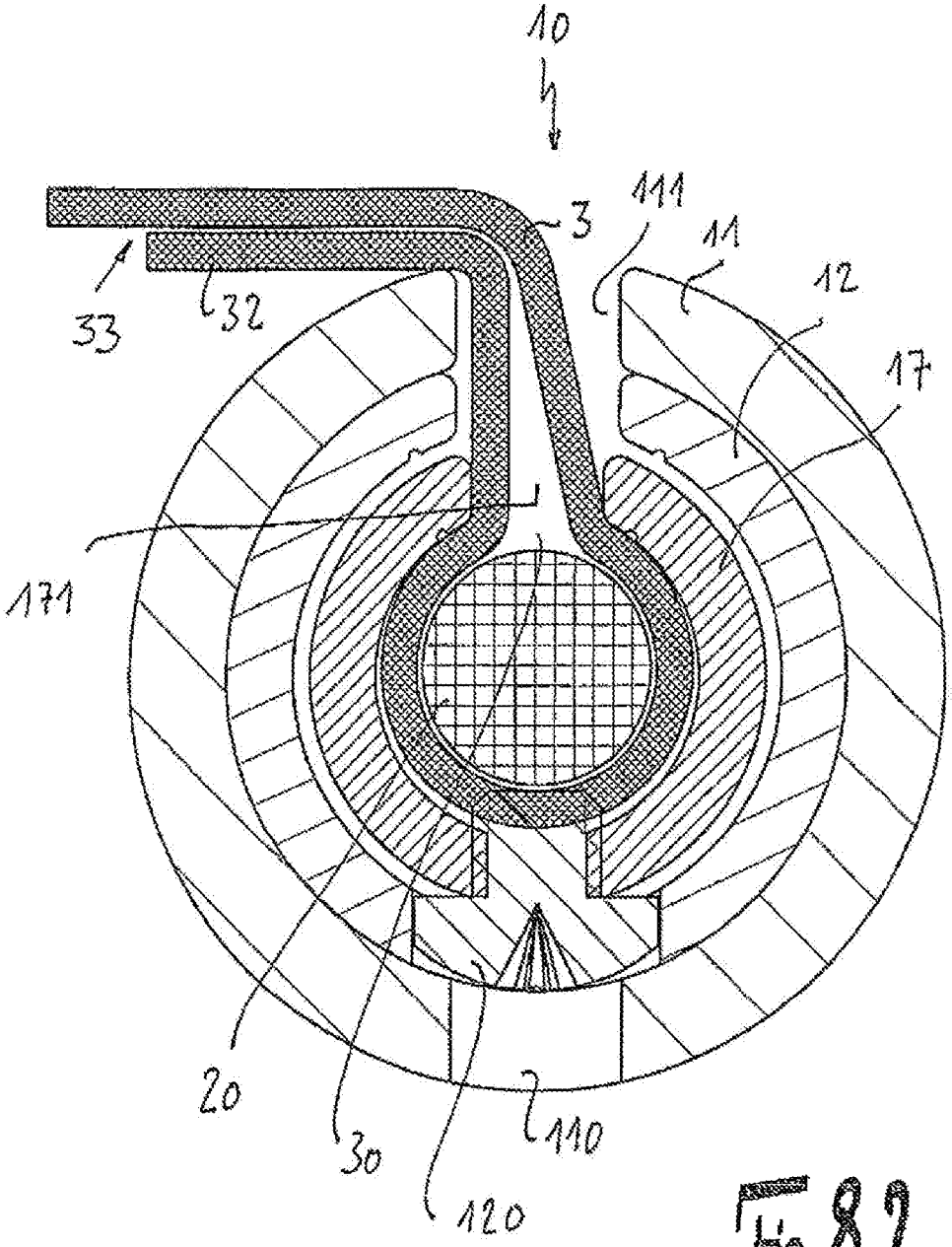
Fig. 8.2

FOLDING WHEELCHAIR

TECHNICAL FIELD

The invention relates to a folding wheelchair having two side frames which are connected to one another via a cross-strut, each have a slit seat tube, have a woven fabric tensioned between them in order to form a surface of a seat and are of identical design, and wherein the woven fabric has loops on two opposite edges, and a cover-retaining rod is accommodated in each of said loops.

BACKGROUND

Such a folding wheelchair is known, for example, from DE 297 24 574 U1. Via the cross-strut, the two side frames can be moved in relation to one another, essentially parallel to one another, between a use position, in which they are spaced apart, and a collapsed position, in which they are adjacent, and can be locked at least in the use position. The side frames, which comprise tubes which are welded to one another, have mounted on them, on the one hand, a respective rear drive wheel and, on the other hand, a respective caster wheel, which can be pivoted about a vertical axis. The cross-strut comprises tubes or connecting rods which cross over one another, are connected to one another at the crossover point in an articulated manner via a cross-strut joint and have their lower ends articulated in each case on a lower seat tube of the side frames.

In order for it to be possible, in the case of the folding wheelchair which is known from U.S. Pat. No. 8,449,032 B2, to adapt the seat surface of the folding wheelchair to potential users of different sizes, the seat depth is adjustable. In order to adjust the seat depth, the seat tubes are of telescopic design. The woven fabric forming the seat surface is positioned over the outer tube and connected to the inner tube. For telescoping purposes, the inner tube is pulled out of the outer tube and pulls along the woven fabric guided around the inner tube, and therefore the seat surface is increased in size. If the inner tube is pushed into the outer tube again, the woven fabric has to be positioned manually around the upper seat tube so that the seat surface does not form any creases, which can result in pressure marks on the user's body.

DE 297 18 536 U1 discloses a folding wheelchair in which, in order to adjust the seat depth, it is possible for the cross-strut, along with the seat accommodated thereon, to be displaced in the direction of travel of the wheelchair and to be fixed in at least two adjustment positions. In order for it to be possible to displace the cross-strut, screw-connections have to be released and then fixed securely again, and this makes it difficult for adaptation to the seat depth to be carried out quickly. Some kind of tool is usually also necessary for this purpose.

DE 202 21 587 U1 discloses a folding wheelchair in which the slit in the seat tube may be longer than the length of the woven seat fabric, and therefore the latter can be displaced in the forward and rearward direction in order for the seat depth to be adjusted. The seat tube is closed off by end caps. The woven seat fabric can be set in position by virtue of end caps of suitable length being selected.

In the case of the folding wheelchair which is described in U.S. Pat. No. 2,914,111, the woven seat fabric is provided with loops at its lateral ends, and a cover-retaining rod is accommodated in said loops. These are also used to fit the woven seat fabric into the slit seat tube. The seat tubes are closed via threaded end caps.

SUMMARY

The invention is based on the object of developing a folding wheelchair of the type in question such that the seat depth is easy to adjust and creasing of the woven fabric is ruled out when the seat depth is being altered.

In order to solve the problem of the invention, a folding wheelchair of the type in question is distinguished by the following features:

a) the seat tubes (10, 10') comprise an outer tube (11, 11') and an inner tube (12, 12'), b) the outer tube (11, 11') has a slit (111), which extends in the longitudinal direction (L) and opens out at least into one outer-tube end (117), c) the inner tube (12, 12') has a slit (121), which extends in the longitudinal direction (L) and opens out at least into one inner-tube end (127), d) each cover-retaining rod (20, 20') is accommodated in an outer tube (11, 11') and opens out into the associated inner tube (12, 12'), e) the woven fabric (3) is guided outward from the inner tube (12, 12') and outer tube (11, 11') through the slits (111, 121), f) the inner tube (12, 12'), the woven fabric (3) and the cover-retaining rod (20, 20') are connected to one another.

By virtue of this embodiment, the woven fabric, which is connected to the inner tube, is displaced in the outer tube, wherein guidance takes place via the cover-retaining rod and the slits in the outer tubes. The seat surface remains unaltered during adjustment of the seat depth; it is merely the case that the seat surface itself is shifted further forward or back. The woven fabric always remains tensioned when the seat depth is being altered. Creasing is ruled out, and this reliably avoids pressure marks on the user's body.

It is preferably the case that a sleeve provided with a slit which is continuous in the longitudinal direction is arranged between each inner tube and each cover-retaining rod, it being possible for said sleeve in particular preferably to be provided with a threaded bore, into which a screw which fixes the woven fabric on the cover-retaining rod can be screwed. The woven fabric is displaced in the outer tube via said sleeve, the sleeve being connected to the inner tube.

The sleeve and the cover-retaining rod are preferably connected to one another via the screw. The screw can engage in the cover-retaining rod through the woven fabric and an aperture or a through-bore.

Instead of providing a sleeve, it is also possible, however, for the inner tube to be connected directly to the cover-retaining rod.

In order to simplify the construction of the inner tube and to create an esthetically pleasing appearance, it is possible, at its end which is directed away from the woven fabric, for the inner tube to be closed by a stopper.

In order to simplify the telescoping capability of the upper seat tubes, the outer tubes are provided with a plurality of holes which are spaced apart parallel to one another in the longitudinal direction and each interact with a pin, which is arranged in the inner tube and is intended to adjust the depth of the seat. The pins can preferably be displaced counter to the force of a spring.

It is also possible for the inner tube to be connected to the outer tube with clamping action or in a force-fitting and/or frictionally fitting manner and this makes it possible for the upper seat tubes to be telescoped in a stepless manner.

BRIEF DESCRIPTION OF THE DRAWINGS

An exemplary embodiment of the invention will be described in more detail hereinbelow with the aid of a drawing, in which:

FIG. 8.1 shows a cross section through the upper seat tube;

FIG. 8.2 shows the cross section according to FIG. 8.1 for an alternative embodiment;

DETAILED DESCRIPTION

Figure 1:
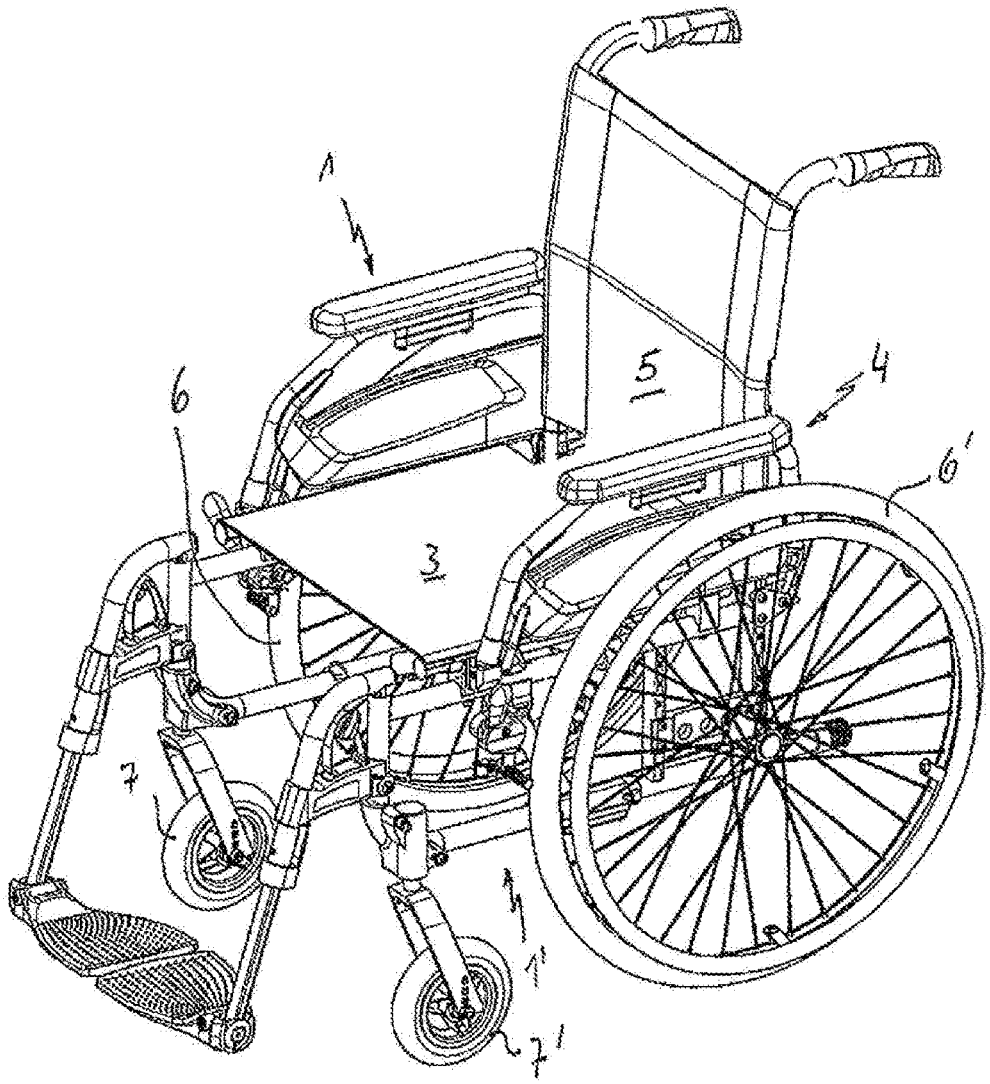
FIG. 1 shows the perspective illustration of a folding wheelchair.
Figure 2:
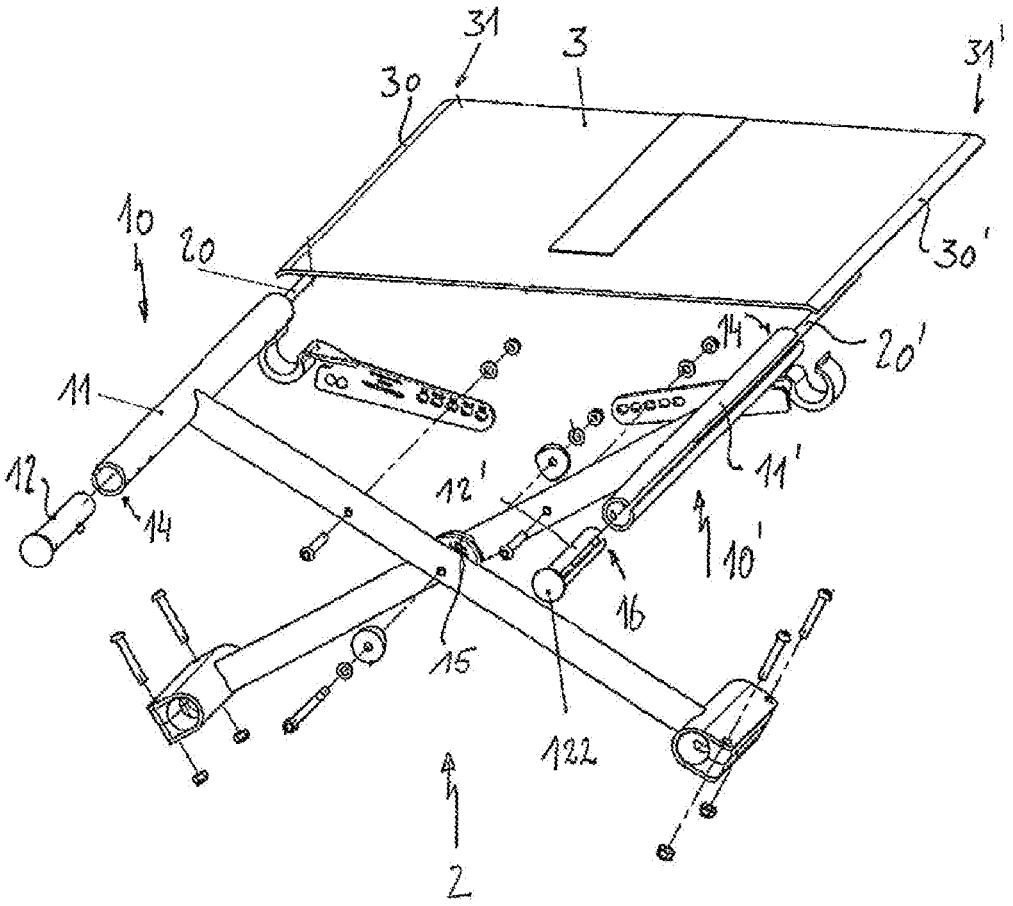
FIG. 2 shows an exploded illustration just of the cross-strut with the seat surface.

The folding wheelchair comprises the two side frames 1, 1', which are connected to one another via a cross-strut 2. The side frames 1, 1', which are of essentially identical (albeit mirror-inverted) design, have arranged on them a respective rear drive wheel 6, 6' and a caster wheel 7, 7', which can be pivoted about a vertical axis. The seat 4, having the seat surface 3 and the backrest 5, is provided between the side frames 1, 1'. The cross-strut 2 has two identically designed upper seat tubes 10, 10' and can be folded together via the cross-strut joint 15.

The upper seat tubes 10, 10' are of identical design, and so the rest of the description will refer possibly only to a seat tube 10 and/or associated details, although the description can then be applied in each case to both seat tubes 10, 10'. The upper seat tubes 10, 10', which are a constituent part of the side frames 1, 1', but are arranged on the cross-strut 2, preferably welded thereto, comprise an outer tube 11, 11' and an inner tube 12, 12'. Both the inner tube 12 and the outer tube 11 are provided, in the longitudinal direction L, with a slit 111 or 121, which extends over the entire length and opens out into both ends 117, 127. The inner tube 12 is closed off at one end 127 by means of a stopper 122. It is also the case that the outer tube 11 can be closed off at one end 117 by a stopper (not shown).

Figure 3:
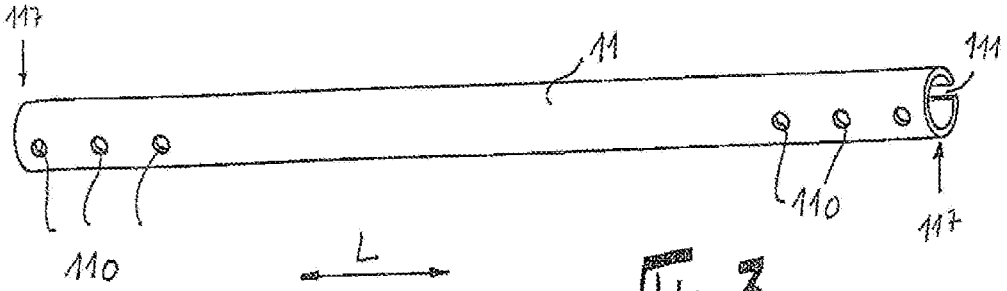
FIG. 3 shows a perspective illustration of the outer tube.
Figure 4:
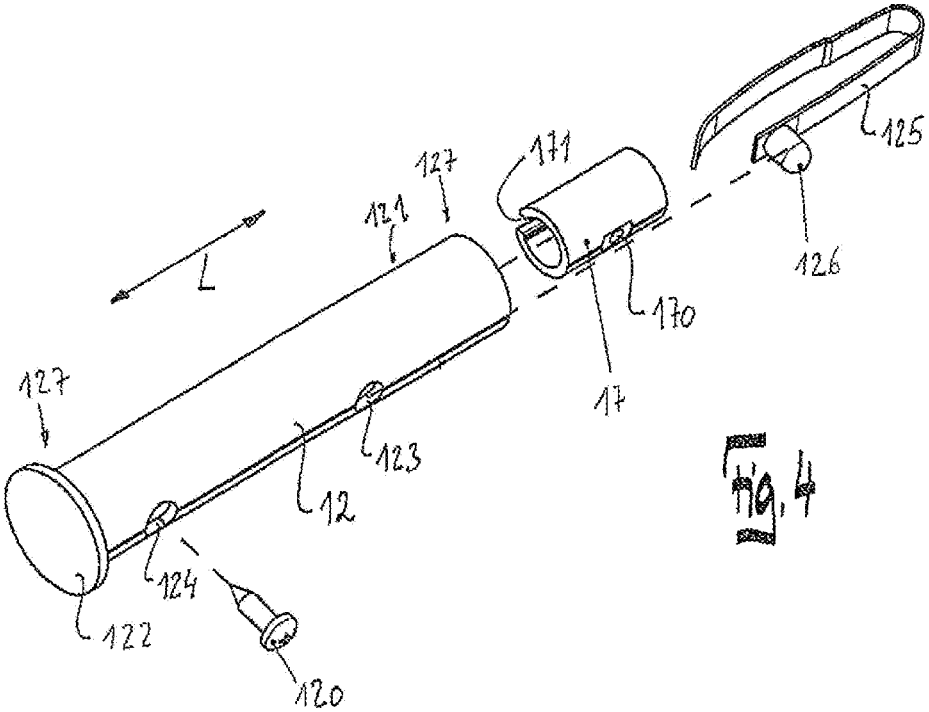
FIG. 4 shows an exploded illustration of a detail from FIG. 2.
Figure 5:
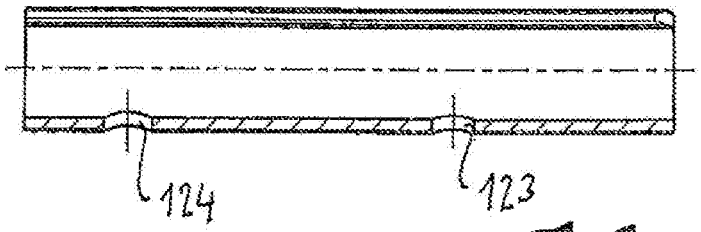
FIG. 5 shows the inner tube in a longitudinal section taken along line V-V in FIG. 6.
Figure 6:
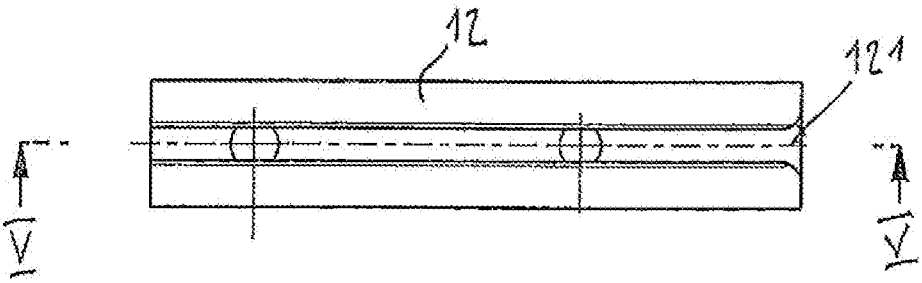
FIG. 6 shows a plan view of the inner tube.
Figure 7:
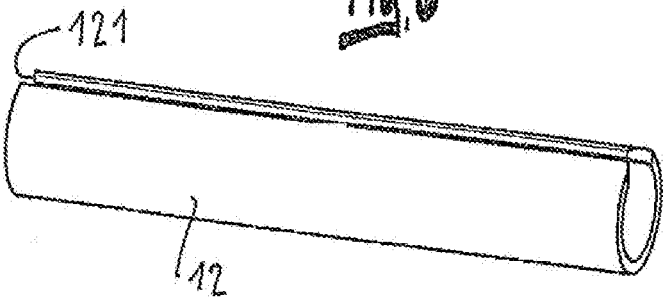
FIG. 7 shows a perspective illustration of the inner tube.

The woven fabric 3 forming the seat surface is provided with a loop 30, 30' on its opposite edges 31, 31', and a cover-retaining rod 20, 20', which is connected to the woven fabric 3, is accommodated in said loops 30, 30'. The cover-retaining rods 20, 20' engage through a sleeve 17, which can be introduced into the inner tube 12. It is also the case that the sleeve 17 is provided with a slit 171 which is continuous in the longitudinal direction L. In order for it to be possible for the outer tube 11 and the inner tube 12 to be telescoped in relation to one another, the outer tube 11 is provided with bores 110 which are spaced apart parallel to one another in the longitudinal direction L (FIG. 3). The interior of the inner tube 12 has inserted in it a clip spring 125 with a pin 126, which projects radially out of the inner tube 12 through a bore 123, provided in the inner tube 12, and can interact with one of the holes 110 in the outer tube 11. The pin 126 can be pushed radially inward counter to the force of the spring 125 (FIG. 4), and this then allows the inner tube 12 to be displaced relative to the outer tube 11, wherein the pin 126, when it coincides with one of the bore 110, latches therein.

FIGS. 8.1 and 8.2 show a cross section through the upper seat tube 10. The inner tube 12, the sleeve 17 and the cover-retaining rod 20 are arranged in the outer tube 11 such that the slits 111, 121 and 171 are aligned with one another. The woven fabric 3 is positioned around the cover-retaining rod 20 by way of a loop 30. The free end 32 can be sewn to the woven-fabric web 3 or fastened thereon via a hook-and-loop fastener 33 (not illustrated specifically here). The screw 120 has been screwed into the threaded bore 170 of the sleeve 17, guided through the woven fabric 3 and inserted into a through-bore (not illustrated specifically here) in the cover-retaining rod 20 (FIG. 8.1), and therefore the woven fabric 3 is fixed to the cover-retaining rod 20. In the case of the alternative which is shown in FIG. 8.1, the screw 120 clamps the woven fabric 3 firmly on the cover-retaining rod 20, or pushes the same onto the cover-retaining rod 20. The screw 120 has its entire head accommodated in the bore 124 in the inner tube 12. If the inner tube 12 is displaced in relation to the outer tube 11, the cover-retaining rod 20 is displaced correspondingly via the sleeve 17, as a result of which the woven fabric 3 is guided in the slits 111, 121, 171 and is likewise displaced in the longitudinal direction L, without the effective surface area of the woven fabric 3 altering in the process. It is only the position of the woven fabric in the upper seat tubes 10, 10' which is altered correspondingly; the surface of the seat 4, in contrast, is not altered. During the operation of telescoping the upper seat tube, the woven fabric 3, rather than creasing, remains tensioned. By virtue of the inner tube 12 being latched in relation to the outer tube 10 by means of the pin 126, the seat depth can be adjusted quickly and without any tools being used.

Figure 9:
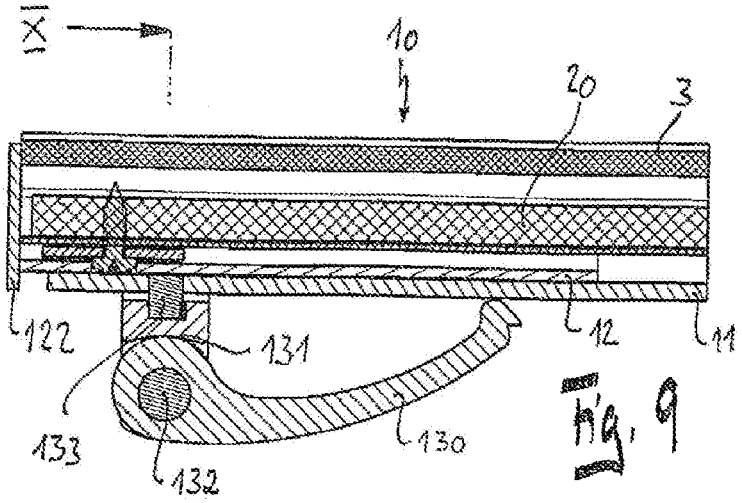
FIG. 9 shows a sectional illustration just through a seat tube.
Figure 10:
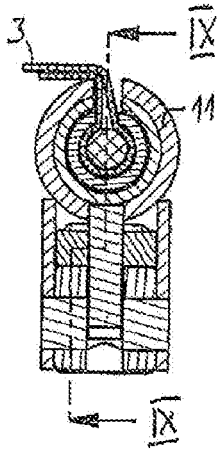
FIG. 10 shows a section along line X-X according to FIG. 9.
Figure 11:
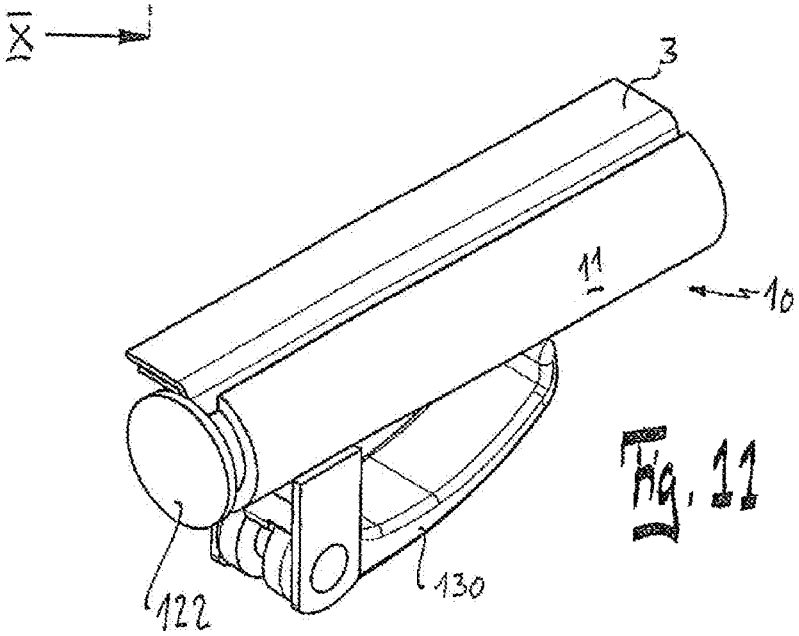
FIG. 11 shows a perspective illustration just of the seat tube.

FIGS. 9 to 11 show an embodiment in which the upper seat tube 10 can be telescoped in a stepless manner. A pivoting lever 130 of the clamping device 13, it being possible for the operative surface 131 of said pivoting lever to be moved eccentrically about a pivot pin 132 into a clamping position (FIG. 9) or a non-clamped position, is used to press onto the inner tube 12 a bolt 133 which is guided through the outer tube 11, as a result of which the outer tube 11 is fixed in relation to the inner tube 12. By virtue of the clamping lever 130 being pivoted into its non-clamped position (not shown), the force-fitting connection is released and the inner tube 12 can be pulled out of the outer tube 11 to the desired extent.

| List of reference signs | |
|---|---|
| 1 | Side frame |
| 1' | Side frame |
| 2 | Cross-strut |
| 3 | Woven fabric |
| 4 | Seat |
| 5 | Backrest |
| 6 | Drive wheel |
| 6' | Drive wheel |
| 7 | Caster wheel |

-continued

| List of reference signs | |
|---|---|
| 7' | Caster wheel |
| 10 | Upper seat tube |
| 10' | Upper seat tube |
| 11 | Outer tube |
| 11' | Outer tube |
| 12 | Inner tube |
| 12' | Inner tube |
| 13 | Device/clamping device |
| 15 | Cross-strut joint |
| 17 | Sleeve |
| 20 | Cover-retaining rod |
| 20' | Cover-retaining rod |
| 30 | Loop |
| 30' | Loop |
| 31 | Edge |
| 31' | Edge |
| 32 | Free end |
| 33 | Hook-and-loop fastener |
| 110 | Hole |
| 111 | Slit |
| 117 | Outer-tube end/end |
| 120 | Screw |
| 121 | Slit |
| 122 | Stopper |
| 123 | Hole |
| 124 | Hole |
| 125 | Clip spring/spring |
| 126 | Pin |
| 127 | Inner-tube end/end |
| 130 | Pivoting lever |
| 131 | Operative surface |
| 132 | Pivot pin |
| 133 | Bolt |
| 170 | Threaded bore |
| 171 | Slit |
| L | Longitudinal direction |

The invention claimed is:

1. A folding wheelchair comprising:

two side frames which are connected to one another via a cross-strut, each side frame having a slit seat tube, the side frames being identical to each other;

a woven fabric tensioned between the side frames in order to form a surface of a seat, the woven fabric having loops on two opposite edges;

a cover-retaining rod positioned in each of the loops;

wherein:

the seat tubes comprise an outer tube and an inner tube, the outer tube has a slit, which extends in the longitudinal direction (L) and opens out at least into one outer-tube end, the inner tube has a slit, which extends in the longitudinal direction (L) and opens out at least into one inner-tube end, each cover-retaining rod is positioned in an outer tube and opens out into the associated inner tube, the woven fabric is guided outward from the inner tube and outer tube, through the slits, and the inner tube, the woven fabric and the cover-retaining rod are connected to one another.

2. The folding wheelchair as claimed in claim 1, further comprising a sleeve provided with a slit which is continuous in the longitudinal direction (L) and arranged between each inner tube and each cover-retaining rod.

3. The folding wheelchair as claimed in claim 2, wherein the sleeve is provided with a threaded bore, into which a screw which fixes the woven fabric on the cover-retaining rod is screwed.

4. The folding wheelchair as claimed in claim 3, wherein the sleeve and the cover-retaining rod are connected to one another via the screw.

5. The folding wheelchair as claimed in claim 1, wherein the inner tube is connected to the cover-retaining rod.

6. The folding wheelchair as claimed in claim 1, wherein, at its end which is directed away from the woven fabric, the inner tube is closed by a stopper.

7. The folding wheelchair as claimed in claim 1, wherein the outer tube is provided with a plurality of holes which are spaced apart parallel to one another in the longitudinal direction L and each interact with a pin, which is arranged in the inner tube, in order to adjust a depth of the seat.

8. The folding wheelchair as claimed in claim 7, wherein the pins can be displaced counter to the force of a spring.

9. The folding wheelchair as claimed in claim 1, wherein the upper seat tubes can be telescoped in a stepless manner.

10. The folding wheelchair as claimed in claim 9, wherein a device connects the outer tube to the inner tube in at least one of a force-fitting manner and a frictionally fitting manner.

11. A folding wheelchair, comprising:

first and second side frames, the side frames being identical to each other, each side frame comprising a slit seat tube having an outer tube and an inner tube, the outer tube having an outer slit, which extends in the longitudinal direction (L) and opens out at least into one outer-tube end, the inner tube having an inner slit, which extends in the longitudinal direction (L) and opens out at least into one inner-tube end;

a cross-strut connecting the first and second side frames;

a woven fabric tensioned between the first and second side frames in order to form a surface of a seat, the woven fabric having loops on two opposite edges;

a cover-retaining rod positioned in each of the loops, each cover-retaining rod being positioned in one of the outer tubes and opening out into an associated inner tube;

wherein the woven fabric is guided outward from the inner tube and outer tube through the slits, and the inner tube, the woven fabric and the cover-retaining rod are connected to one another.

12. The folding wheelchair as claimed in claim 11, further comprising a sleeve having a sleeve slit, the sleeve being continuous in the longitudinal direction (L) and arranged between each inner tube and each cover-retaining rod.

13. The folding wheelchair as claimed in claim 12, wherein the sleeve is provided with a threaded bore, the threaded bore being sized to receive a screw to secure the woven fabric to the cover-retaining rod.

14. The folding wheelchair as claimed in claim 13, wherein the sleeve and the cover-retaining rod are connected to one another with the screw.

15. The folding wheelchair as claimed in claim 11, wherein the inner tube is connected to the cover-retaining rod.

16. The folding wheelchair as claimed in claim 11, wherein the inner tube is closed by a stopper at an end of the inner tube which is directed away from the woven fabric.

17. The folding wheelchair as claimed in claim 11, wherein the outer tube is provided with a plurality of holes, which are spaced apart parallel to one another in the longitudinal direction L, the plurality of holes each interacting with a pin, the pin being arranged in the inner tube and operable to adjust a depth of the seat.

18. The folding wheelchair as claimed in claim 17, wherein the pin is displaceable counter to the force of a spring.

19. The folding wheelchair as claimed in claim 11, wherein the upper seat tubes are configured to telescope in a stepless manner.

20. The folding wheelchair as claimed in claim 19, wherein a device connects the outer tube to the inner tube in at least one of a force-fitting manner and a frictionally fitting manner.

* * * * *